United States Patent [19]

Schmitt

[11] Patent Number: 4,527,502

[45] Date of Patent: Jul. 9, 1985

[54] EXPELLING MECHANISM FOR DISCHARGE TUBES AND DRAIN TUBES OF SUBMARINES

[75] Inventor: Josef Schmitt, Dänischenhagen, Fed. Rep. of Germany

[73] Assignee: Krup MaK Maschinenbau GmbH, Kiel, Fed. Rep. of Germany

[21] Appl. No.: 604,530

[22] Filed: Apr. 27, 1984

[30] Foreign Application Priority Data

Jun. 18, 1983 [DE] Fed. Rep. of Germany ..... 3322020

[51] Int. Cl.[3] ..... F16K 31/143

[52] U.S. Cl. ..... 114/319; 251/54; 92/9; 114/238

[58] Field of Search ..... 114/319, 318, 316, 238; 137/514.7; 251/55, 44, 54; 91/402, 408; 92/10, 8, 12, 9

[56] References Cited

U.S. PATENT DOCUMENTS

| | | | |
|---|---|---|---|
| 3,002,581 | 10/1961 | Deibel | 91/10 |
| 3,386,339 | 6/1968 | Selsam | 91/408 |
| 3,818,805 | 6/1974 | Johansson | 91/402 |
| 3,833,200 | 9/1974 | McCombs | 91/408 |
| 4,168,800 | 9/1979 | Quick | 92/8 |
| 4,318,530 | 3/1982 | Lissmyr | 251/54 |

FOREIGN PATENT DOCUMENTS

| | | | |
|---|---|---|---|
| 2144139 | 8/1971 | Fed. Rep. of Germany | 92/8 |
| 541680 | 4/1956 | Italy | 92/9 |
| 16807 | of 1913 | United Kingdom | 92/9 |
| 779666 | 11/1980 | U.S.S.R. | 92/9 |

*Primary Examiner*—Sherman D. Basinger
*Assistant Examiner*—C. T. Bartz
*Attorney, Agent, or Firm*—Erwin S. Teltscher

[57] ABSTRACT

An expelling mechanism adapted for use with discharge tubes and drain tubes of submarines for ejecting a weapon by compressed air includes a chamber formed with an outlet opening, and adapted to substantially communicate selectively with a storage container holding compressed gas, a discharge valve which may be moved towards the opening in a closing direction, and away therefrom in an opening direction at a selectable opening velocity, and a hydraulic control device for controlling the movement of the discharge valve. The hydraulic control device includes a cylinder adapted to be filled with hydraulic fluid, a piston reciprocally movable along a stroke within the cylinder, and partitioning the cylinder into two cylinder chambers, an overflow channel establishing communication between the cylinder chambers, and a connecting device connecting the discharge valve with the hydraulic control device. The outlet opening and the overflow channel have cross-sections which are variable in dependence of the stroke, respectively, so that the outlet opening increases as the discharge valve moves in the opening direction. The opening velocity of the discharge valve may be controlled, and different respective cross-sections of the overflow channel may be set in dependence of the stroke.

10 Claims, 5 Drawing Figures

EXPELLING MECHANISM FOR DISCHARGE TUBES AND DRAIN TUBES OF SUBMARINES

BACKGROUND OF THE INVENTION

The invention relates to an expelling mechanism, including a discharge valve, for use in connection with discharge tubes and drain tubes of submarines for ejecting a weapon by means of compressed gas, which is supplied thereto through associated containers for the compressed gas, and wherein the expelling mechanism may be controlled through control means, an outlet opening is increased during the gas discharge process, and the gas velocity passing through the opening may be controlled.

In mechanisms of this type, which are also known from No. DE-31-22631 a problem exists, namely how to implement not only the opening function, but in addition how to obtain a controlling function, so as to eject the weapons to be expelled at a predetermined velocity at any immersion depth. It is already known to open the main discharge valve of the expelling mechanism at different respective velocities, which are adjustable, and can be matched to the respective immersion depth, for example, to attain a low velocity at a low immersion depth, but a high velocity at a great immersion depth. Consequently the compressed gas stored in the expelling mechanism can escape slowly in the case of low immersion depths, but quickly in the case of considerable immersion depths, so as to equalize the loss of any displacement volume due to the immersion depth.

SUMMARY OF THE INVENTION

It is an object of the invention to obtain a simple embodiment of known mechanisms by a further development thereof for controlling the opening velocity, so as to obtain an adequately constant velocity of ejection.

This object is attained according to the invention, by the discharge valve being controllable by hydraulic control means through connecting means, the hydraulic control means including a cylinder, and a piston reciprocally movable along a stroke within the cylinder so as to partition the cylinder into two cylinder chambers, as well as by overflow means establishing communication between the cylinder chambers; the overflow means has variable cross-sections which may be set in dependence of the stroke. Consequently it is possible to control the ejection velocity in dependence of the stroke of the discharge valve, as well as to control variation of the opening velocity through the hydraulic control means.

Further embodiments and developments of the invention can be ascertained from the features of the dependent claims. Of course is it also possible to arrange for the opening velocity of the discharge valve to have an approximately constant and low value in one region of the discharge stroke, to have in another region of the stroke a constant, and slightly higher value, but to have again a low value in a third region of the stroke.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
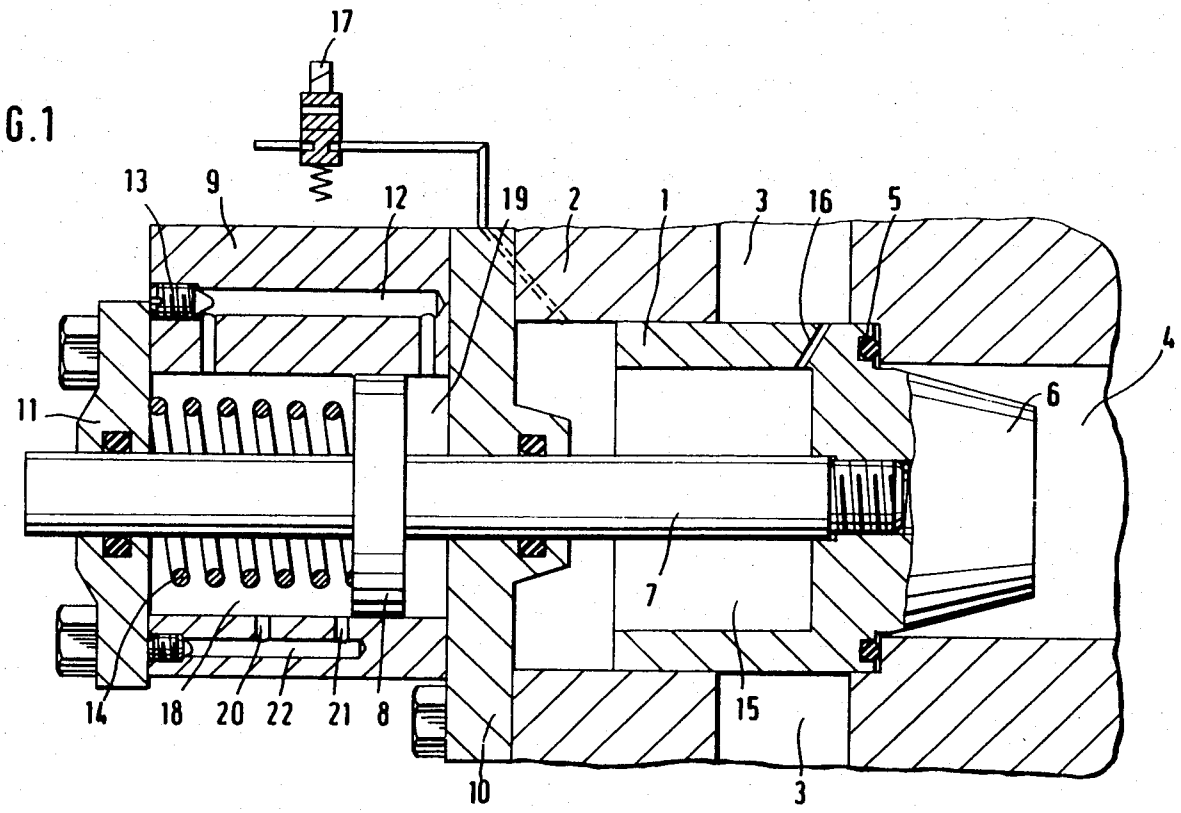
FIG. 1 is a longitudinal section of a first version of the expelling mechanism, wherein the overflow means are implemented as longitudinal bores in the cylinder.

Referring now to the drawing, a discharge valve 1 is disposed in a chamber 2 for compressed air so as to close off the interior of a container 3 from an outlet opening 4 having a certain cross-sectional area with the aid of a sealing element 5. When the discharge valve 1 is opened, the cross-sectional area of the outlet opening 4 is gradually increased by means of an element 6 having the shape of a truncated cone. The discharge valve 1 is connected through connecting means, such as a piston rod 7 with a hydraulic piston 8, which is reciprocally movable within a hydraulic cylinder 9, and partitions the cylinder 9 into two cylinder chambers. The hydraulic cylinder 9 is closed off by a floor member 10 and a cover 11. Hydraulic fluid, which is disposed in each cylinder chamber, communicates through an overflow channel 12, in which there is located a throttle element 13. The discharge valve 1 is maintained at rest by a spring 14 in the closure position, and is additionally securely held in the closure position due to compressed gas being stored behind the discharge valve 1 in a space 15, the compressed gas being able to overflow or escape from the interior container 3 through a small bore 16.

If an opening process is initiated, then the space 15 behind the discharge valve 1 is aerated by means of a ventilation valve 17. The compressed gas acting on the front side of the discharge valve 1 is therefore in a position to force the discharge valve 1 to open, namely force it leftwardly, as seen in FIG. 1. Pressure is then built up in the hydraulic chamber 18, as a result of which the hydraulic fluid may overflow into the hydraulic chamber 19 through the throttle element 13 and the channel 12. The opening velocity of the discharge valve 1 is determined here by the magnitude of the cross-sectional area of the channel 12 released by the throttle element 13, which is relatively small.

If the hydraulic piston 8 is positioned between two bores 20 and 21, which are spaced further apart than the width of the hydraulic piston 8, then an additional cross-sectional overflow area becomes effective due to the bores 20 and 21, and an additional connecting channel 22, which permits the discharge valve to travel at a high velocity into a second position, in which the bore 20 is again closed by the piston 8. This in turn means that the piston 8 is again located in a third segment having a lower opening velocity, following passage through a segment in which it travels at a higher velocity.

Figure 3:
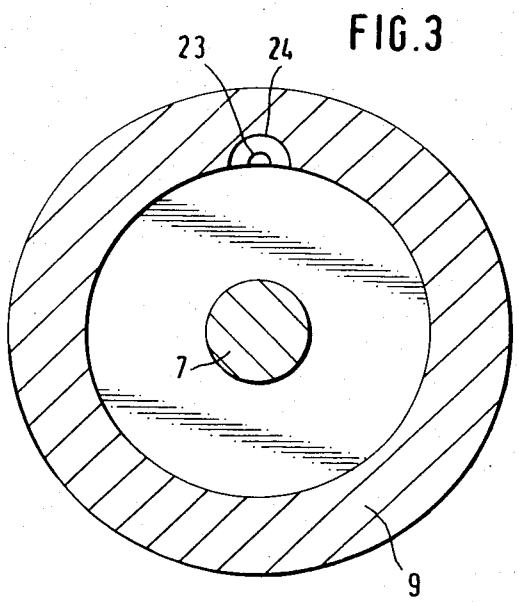
FIG. 3 is a cross-section of FIG. 2 along line III—III.
Figure 2:
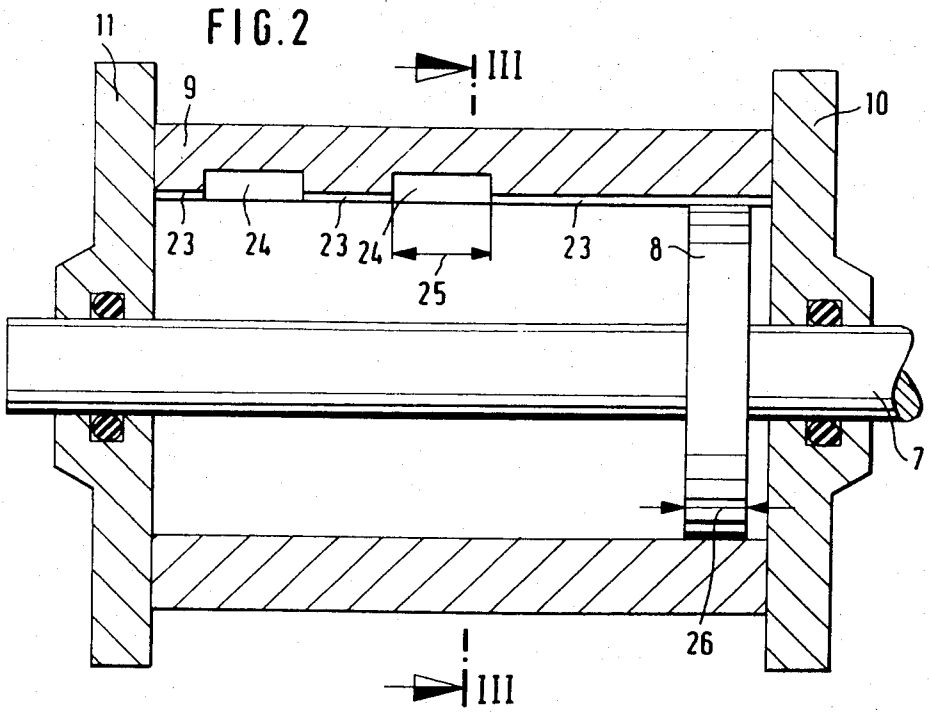
FIG. 2 is a longitudinal section of a second version of the expelling mechanism, wherein the overflow means are implemented as longitudinal grooves in the cylinder.

The same effect is obtained according to FIGS. 2 and 3, if the cylinder 9 is provided with longitudinal grooves 23 having a cross-section smaller than those of grooves 24, the latter alternating with the grooves 23. The length 25 of the longitudinal grooves 24 must exceed the width of the hydraulic piston 8.

Figure 5:
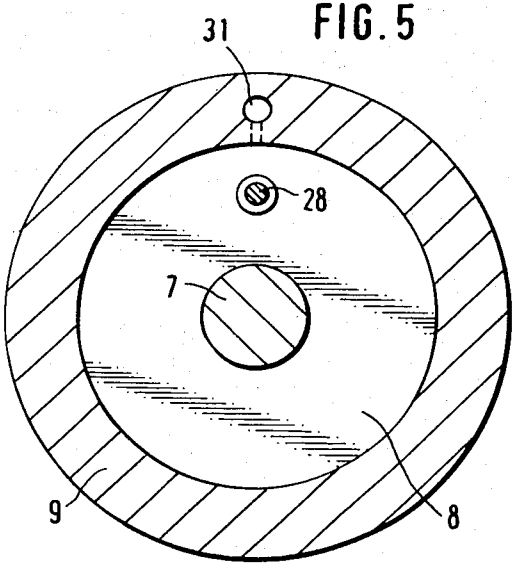
FIG. 5 is a cross-section along line V—V of FIG. 4.
Figure 4:
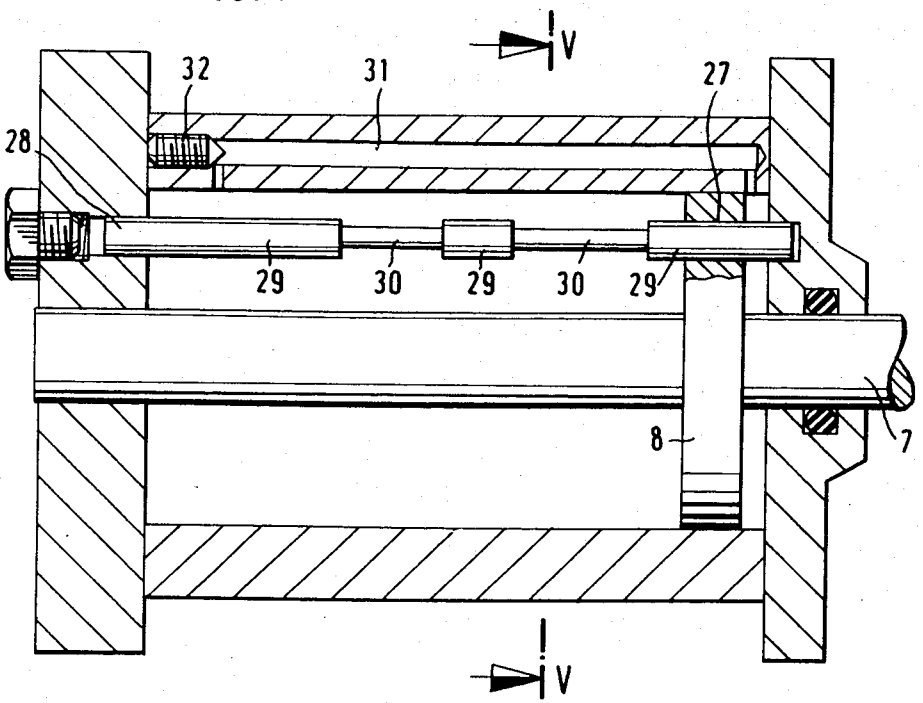
FIG. 4 is a longitudinal section of a third version of the expelling mechanism, wherein the overflow means are implemented as bores in the piston, as well as by means of an associated caliber rod, and additional longitudinal bores in the cylinder.

According to FIGS. 4 and 5, there is shown an additional embodiment, in which the hydraulic piston 8 is provided with a calibrated bore 27, in which there slides a calibrating, or breech rod 28. The breech rod 28 has diameters 29 of a large width alternating with diameters 30 of a smaller width, so that the piston 8 travels here also alternately through regions of cross-sectional areas of small overflow alternating with cross-sectional areas of large overflow.

Finally also the bore 27 and the calibrating or breech rod 28 can be made so narrow in its cross-sectional portions 29, that the remaining annular gap is no longer effective for any overflow action. In that case it is necessary to arrange for an additional overflow channel 31 in the cylinder 9, and a throttle element 32 in the additional overflow channel 31.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. An expelling mechanism adapted for use with discharge tubes and drain tubes of submarines for ejecting a weapon by means of compressed air, comprising in combination a chamber formed with an outlet opening, and being adapted to substantially communicate selectively with a storage container holding compressed gas, a discharge valve movable towards said opening in a closing direction, and away therefrom in an opening direction at a selectable opening velocity, hydraulic control means for controlling the movement of said discharge valve including a cylinder adapted to be filled with hydraulic fluid, a piston reciprocally movable along a stroke within said cylinder along said opening and closing directions, respectively, and partitioning said cylinder into two cylinder chambers, overflow means operable during each of said directions, and establishing communication between said cylinder chambers, and connecting means connecting said discharge valve with said hydraulic control means, said outlet opening and said overflow means having cross-sections variable in dependence of said stroke, respectively, so that the outlet opening increases as the discharge valve moves in the opening direction, the opening velocity of said discharge valve is controllable, and different respective cross-sections of said overflow means operable during each of said directions are settable in dependence of said stroke, irrespective of whether the piston moves in an opening direction on in a closing direction.

2. The expelling mechanism as claimed in claim 1, wherein said overflow means includes at least one longitudinal bore formed in said cylinder, and wherein said cylinder is formed with additional channels, and an additional longitudinal bore, said additional longitudinal bore selectably communicating with said two cylinder chambers in dependence of said stroke.

3. The expelling mechanism as claimed in claim 1, wherein said overflow means is formed in said cylinder and includes a first set of grooves having a predetermined cross-section alternating with a second set of grooves having a cross-section exceeding said predetermined cross-section.

4. The expelling mechanism as claimed in claim 1, wherein said overflow means is formed as a bore in said piston, and further including a calibrating rod having sections of different respective diameters passing through said bore.

5. The expelling mechanism as claimed in claim 1, wherein said overflow means includes a first overflow channel of relatively large cross-section formed as a bore in said piston, and a calibrating rod received in said bore, and a second overflow channel of a cross-section smaller than that of said first overflow channel formed as at least one longitudinal recess in said cylinder.

6. The expelling mechanism as claimed in claim 5, wherein said longitudinal recess is formed as a longitudinal bore.

7. The expelling mechanism as claimed in claim 5, wherein said longitudinal recess is formed as a longitudinal groove.

8. The expelling mechanism as claimed in claim 1, wherein said overflow means is free of any non-return valve means.

9. The expelling mechanism as claimed in claim 1, wherein said discharge valve has a closure position, and further comprising resilient means, and reinforcing means aiding said resilient means for holding said discharge valve at rest in said closure position.

10. The expelling mechanism as claimed in claim 9, wherein said reinforcing means includes compressed gas.

* * * * *